US011344072B2

(12) United States Patent
Hjort et al.

(10) Patent No.: US 11,344,072 B2
(45) Date of Patent: May 31, 2022

(54) NURSING GARMENT

(71) Applicant: H & M HENNES & MAURITZ AB, Stockholm (SE)

(72) Inventors: Amelie Hjort, Farsta (SE); Emily Joansson, Stockholm (SE)

(73) Assignee: H & M HENNES & MAURITZ AB, Stockholm (SE)

( * ) Notice: Subject to any disclaimer, the term of this patent is extended or adjusted under 35 U.S.C. 154(b) by 32 days.

(21) Appl. No.: 16/497,913

(22) PCT Filed: Mar. 23, 2018

(86) PCT No.: PCT/EP2018/057533
§ 371 (c)(1),
(2) Date: Sep. 26, 2019

(87) PCT Pub. No.: WO2018/177960
PCT Pub. Date: Oct. 4, 2018

(65) Prior Publication Data

US 2020/0383398 A1 Dec. 10, 2020

(30) Foreign Application Priority Data

Mar. 27, 2017 (SE) ..... 1750359-0

(51) Int. Cl.
*A41D 1/215* (2018.01)

(52) U.S. Cl.
CPC ..... *A41D 1/215* (2018.01)

(58) Field of Classification Search
CPC ..... A41D 1/215; A41D 1/21; A41D 27/10; A41D 27/14; A41B 1/06; A41C 3/04
(Continued)

(56) References Cited

U.S. PATENT DOCUMENTS 4,528,699 A 7/1985 Hughes
2005/0028243 A1* 2/2005 Polzin ..... A41D 1/215 2/104

(Continued)

FOREIGN PATENT DOCUMENTS

CN 204232330 U * 4/2015
CN 204635120 U 9/2015

(Continued)

OTHER PUBLICATIONS

Woven Tank Top blog by Megan Nielsen Patterns dated 2013 and retrieved by Examiner on Nov. 6, 2020 at https://megannielsen.com/products/eucalypt-woven-tank-dress-sewing-pattern (Year: 2013).*

(Continued)

*Primary Examiner* — F Griffin Hall
(74) *Attorney, Agent, or Firm* — Faegre Drinker Biddle & Reath LLP

(57) ABSTRACT

In accordance with one or more embodiments herein, a garment suitable for nursing is provided. The garment comprises an outer layer and an inner layer extending below the outer layer. The inner layer comprises an inner layer front section and an inner layer back section that are attached to each other at least at the sides, and the outer layer comprises an outer layer front section and an outer layer back section that are attached to each other at least at the sides. The inner layer and the outer layer are attached to each other in at least one point above the lowermost edges of the sleeve openings of the inner layer, and the outer layer comprises a lower edge arranged below the lowermost edges of the sleeve openings of the inner layer, so that a breast can be accessed through one of the sleeve openings of the inner layer by lifting the lower edge of the outer layer. The garment facilitates breastfeeding, since an outer layer which is not attached to the inner layer at the sides is easy to lift in (Continued)

order to access a breast through one of the sleeve openings of the inner layer.

15 Claims, 6 Drawing Sheets

(58) Field of Classification Search
USPC ..... 2/104
See application file for complete search history.

(56) References Cited

U.S. PATENT DOCUMENTS

| | | | | |
|---|---|---|---|---|
| 2008/0276346 | A1 | 11/2008 | Thunstedt | |
| 2008/0301849 | A1* | 12/2008 | Levy | A41D 1/04 2/243.1 |
| 2009/0265831 | A1 | 10/2009 | Hendrickson | |
| 2013/0217302 | A1 | 8/2013 | Raj | |
| 2016/0366953 | A1* | 12/2016 | Watts | A41D 1/04 |

FOREIGN PATENT DOCUMENTS

| | | | | | |
|---|---|---|---|---|---|
| CN | 205072117 | U | | 3/2016 | |
| DE | 10 2004 006 0597 | A1 | | 2/2005 | |
| EP | 1 127 499 | B1 | | 5/2008 | |
| ES | 1 058 947 | U | | 3/2005 | |
| ES | 1058947 | U | * | 3/2005 | A41D 1/215 |
| ES | 1 256 933 | U | | 5/2016 | |
| RU | 2 408 239 | C1 | | 1/2011 | |
| RU | 2 417 717 | C1 | | 5/2011 | |
| SE | 525708 | C2 | | 4/2005 | |
| WO | WO-2005/044028 | A1 | | 5/2005 | |
| WO | WO-2009/008804 | A1 | | 1/2009 | |

OTHER PUBLICATIONS

Swedish Office Action dated Oct. 4, 2018 for priority Patent Application No. 1750359-0.

* cited by examiner

NURSING GARMENT

CROSS-REFERENCE TO PRIOR APPLICATIONS

This application is a § 371 National Stage Application of PCT International Application No. PCT/EP2018/057533 filed Mar. 23, 2018, which claims priority to Swedish Application No. 1750359-0 filed on Mar. 27, 2017, both of which are incorporated herein in their entirety.

TECHNICAL FIELD

The present disclosure relates generally to garments suitable for nursing.

BACKGROUND

Nursing garments which provide access to the breasts by lifting an overlapping front part of the garment are known from e.g. US2009/0265831, EP1127499, DE102004006597, US2008/0276346 and ES1058947U.

The nursing garment described in US2009/0265831 has an outer bodice which is adapted for pulling up to uncover an inner bodice with round breast-feeding openings.

The nursing garment described in EP1127499 has an upper portion and a lower portion at the front which define an overlapping opening that is horizontally arranged in level with the bosom and defined at the sides by vertical seams. A similar nursing garment is shown in DE102004006597.

The nursing garments described in US2008/0276346 and ES1058947U each have a top piece and a bottom piece at the front with a horizontal access opening, where the bottom piece is fastened at the neck on the inside of the top piece and has recesses for the breasts.

Problems with the Prior Art

The nursing garment described in US2009/0265831 has an integrated bra-like function, and could not be used together with a separate bra, because it would in that case not be possible to access the breasts. This nursing garment would thus only be suitable for women of a certain breast size.

The nursing garments described in EP1127499, DE102004006597, US2008/0276346 and ES1058947U all comprise double layers at the front of the garment, where the breasts are accessed by lifting the upper layer. However, since both the upper layer and the lower layer of the front part are attached to the back part, the breasts can only be accessed through the opening formed at the front between the upper layer and the lower layer.

The nursing garments described in EP1127499 and DE102004006597 have the further disadvantage that the lower portion may begin to sag after repeated use, since there is nothing that holds it up in the middle.

The nursing garments described in US2008/0276346, ES1058947U and US2009/0265831 have the further disadvantage that the breasts are not covered by the lower layer for warmth.

There is thus a need for an improved nursing garment.

SUMMARY

The above described problems are addressed by the claimed garment, which comprises an outer layer and an inner layer extending below the outer layer, wherein the inner layer comprises an inner layer front section and an inner layer back section that are attached to each other at least at the sides, and the outer layer comprises an outer layer front section and an outer layer back section that are attached to each other at least at the sides, and wherein the inner layer and the outer layer are attached to each other in at least one point above the lowermost edges of the sleeve openings of the inner layer, and the outer layer comprises a lower edge arranged below the lowermost edges of the sleeve openings of the inner layer, so that a breast can be accessed through one of the sleeve openings of the inner layer by lifting the lower edge of the outer layer. The claimed garment facilitates breastfeeding, since an outer layer which is not attached to the inner layer below the sleeve openings but instead hangs freely is easy to lift in order to access a breast through one of the sleeve openings of the inner layer. The inner layer is preferably sleeveless, since this enables easier access to a breast through one of the sleeve openings of the inner layer.

In embodiments, the inner layer front section and the inner layer back section are also attached to each other along the shoulders. In this way, a complete inner layer which could be separately worn is created, and the inner layer and the outer layer do not have to be attached to each other along the shoulders.

In embodiments, the outer layer front section and the outer layer back section are also attached to each other along the shoulders. In this way, a complete outer layer which could be separately worn is created, and the inner layer and the outer layer do not have to be attached to each other along the shoulders.

In embodiments, the inner layer and the outer layer are attached to each other along at least a part of the shoulders. This connects the layers well together and makes the garment easy to put on without having to adjust the inner layer.

In embodiments, the inner layer and the outer layer are attached to each other around at least a part of the neckline. This may ensure that the inner layer will not show through the neckline of the outer layer.

In embodiments, both the inner layer and the outer layer are arranged to cover the breasts when the garment is worn. This may ensure that the breasts are kept warm.

In embodiments, the sleeve openings of the inner layer are larger at the front than at the back, for easier access to the breasts.

The lower edge of the outer layer is arranged a suitable, preferably short distance below the lowermost edges of the sleeve openings of the inner layer. In embodiments, the distance between the lowermost edges of the sleeve openings of the inner layer and the lower edge of the outer layer at least at one of the sides is 2-15 cm, or 10 cm or less, or 5 cm or less. This ensures that the outer layer completely covers the sleeve openings of the inner layer, so that the breasts are shielded from view, but at the same the outer layer does not to extend too far below the lowermost edges of the sleeve openings of the inner layer, so as to make it unnecessarily cumbersome to lift the lower edge of the outer layer in order to access a breast through one of the sleeve openings of the inner layer.

In embodiments, the lower edge of the outer layer follows a straight horizontal line. The lower edge of the outer layer may however instead follow a curved or asymmetrical line, so that the outer layer is longer and/or shorter at some points along the circumference than at other points along the circumference.

The above described problems are further addressed by the claimed method of manufacturing a garment suitable for nursing comprising an outer layer and an inner layer extending below the outer layer, wherein the outer layer comprises a lower edge arranged to be positioned below the lowermost edges of the sleeve openings of the inner layer, the method comprising manufacturing the inner layer by attaching an inner layer front section and an inner layer back section to each other at least at the sides, manufacturing the outer layer by attaching an outer layer front section and an outer layer back section to each other at least at the sides, and attaching the inner layer and the outer layer to each other in at least one point above the lowermost edges of the sleeve openings of the inner layer, so that a breast can be accessed through one of the sleeve openings of the inner layer by lifting the lower edge of the outer layer. The claimed method manufactures a garment that facilitates breastfeeding, since an outer layer which is not attached to the inner layer below the sleeve openings but instead hangs freely is easy to lift in order to access a breast through one of the sleeve openings of the inner layer. The inner layer is preferably sleeveless, since this enables easier access to a breast through one of the sleeve openings of the inner layer.

In embodiments, the method further comprises attaching the inner layer front section and the inner layer back section to each other also along the shoulders. In this way, a complete inner layer which could be separately worn is created, and the inner layer and the outer layer do not have to be attached to each other along the shoulders.

In embodiments, the method further comprises attaching the outer layer front section and the outer layer back section to each other also along the shoulders. In this way, a complete outer layer which could be separately worn is created, and the inner layer and the outer layer do not have to be attached to each other along the shoulders.

In embodiments, the method further comprises attaching the inner layer and the outer layer to each other along at least a part of the shoulders. This connects the layers well together and makes the garment easy to put on without having to adjust the inner layer.

In embodiments, the method further comprises attaching the inner layer and the outer layer to each other around at least a part of the neckline. This may ensure that the inner layer will not show through the neckline of the outer layer.

In embodiments, the method further comprises manufacturing the inner layer using an inner layer front section that is arranged to cover the breasts when the garment is worn. This may ensure that the breasts are kept warm.

In embodiments, the method further comprises manufacturing the inner layer using an inner layer front section with sleeve openings that are larger at the front than at the back, for easier access to the breasts.

In embodiments, the method further comprises attaching the inner layer and the outer layer to each other in such a way that the distance between the lowermost edges of the sleeve openings of the inner layer and the lower edge of the outer layer at least at one of the sides is 2-15 cm, or 10 cm or less, or 5 cm or less. This ensures that the outer layer completely covers the sleeve openings of the inner layer, so that the breasts are shielded from view, but at the same the outer layer does not to extend too far below the lowermost edges of the sleeve openings of the inner layer, so as to make it unnecessarily cumbersome to lift the lower edge of the outer layer in order to access a breast through one of the sleeve openings of the inner layer.

In embodiments, the method further comprises manufacturing the outer layer using an outer layer front section and an outer layer back section each of which follows a straight horizontal line. The method may however instead comprise manufacturing the outer layer using an outer layer front section and/or an outer layer back section which follows a curved or asymmetrical line, so that the outer layer becomes longer and/or shorter at some points along the circumference than at other points along the circumference.

The inner layer front section and the inner layer back section are not necessarily physically separated pieces—they may e.g. constitute a single piece which is connected at the shoulders before being folded over so that the inner layer front section and the inner layer back section can be attached to each other at the sides, or a single piece which is connected at one of the sides before being folded over so that the inner layer front section and the inner layer back section can be attached to each other at the other side, and possibly also along the shoulders.

The outer layer front section and the outer layer back section are not necessarily physically separated pieces—they may e.g. constitute a single piece which is connected at the shoulders before being folded over so that the outer layer front section and the outer layer back section can be attached to each other at the sides, or a single piece which is connected at one of the sides before being folded over so that the outer layer front section and the outer layer back section can be attached to each other at the other side, and possibly also along the shoulders.

Further, the inner layer front section, the inner layer back section, the outer layer front section and the outer layer back section may be manufactured from any number of physical pieces.

The inner layer preferably defines the length of the garment, since it extends below the outer layer and is thus preferably also longer than the outer layer. The terms above, below, lowermost, etc. in this application all refer to a garment as it is worn, with the shoulders and/or the neck being the highest parts. The feature that the inner layer and the outer layer are attached to each other in at least one point above the lowermost edges of the sleeve openings of the inner layer thus means that the inner layer and the outer layer are attached to each other in at least one point between the lowermost edges of the sleeve openings of the inner layer and the upper edge of the garment (usually the shoulders or the neckline, unless the garment is off-shoulder).

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

The present disclosure relates generally to garments suitable for nursing. Embodiments of the disclosed solution are presented in more detail in connection with the figures.

Figure 1:
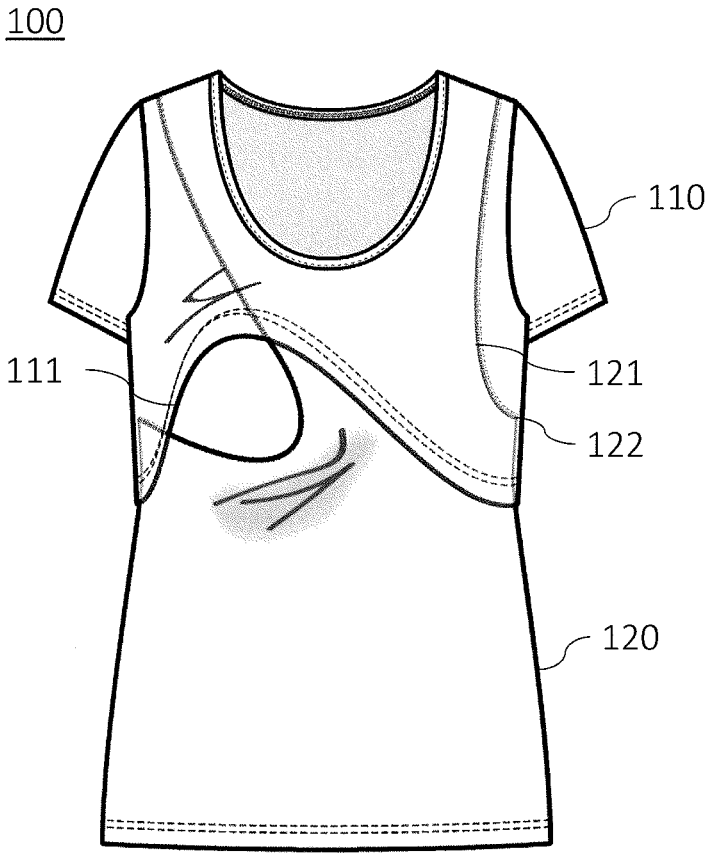
FIG. 1 illustrates use of a garment suitable for nursing in accordance with one or more embodiments described herein.

FIG. 1 illustrates use of a garment 100 suitable for nursing in accordance with one or more embodiments described herein. As can be seen in FIG. 1, the garment 100 comprises an inner layer 120 and an outer layer 110, where the lower edge 111 of the outer layer 110 may be lifted in order to access a breast through one of the sleeve openings 121 of the inner layer 120.

Figure 2A:
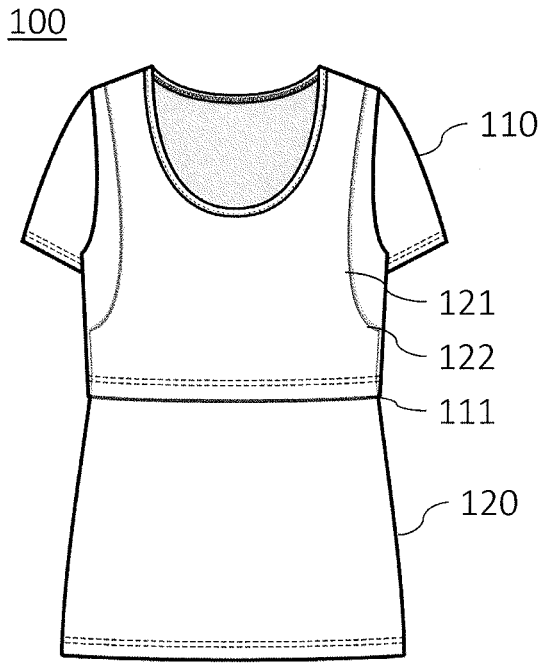
FIGS. 2*a*-2*d* illustrate different views of the garment shown in FIG. 1.
Figure 2B:
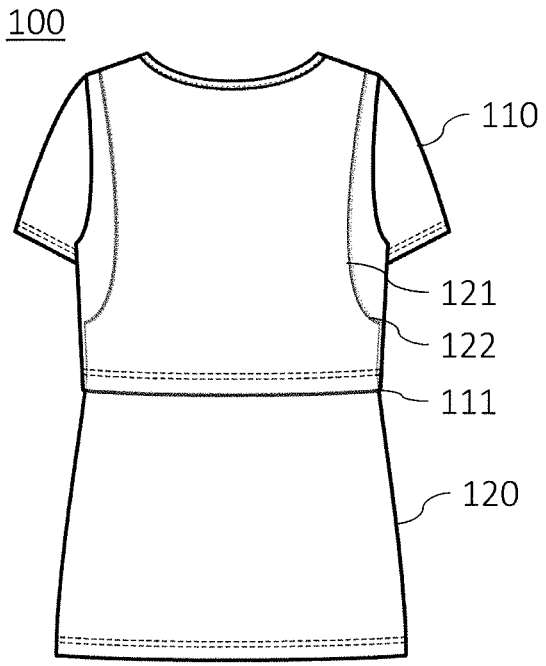
Figure 2C:
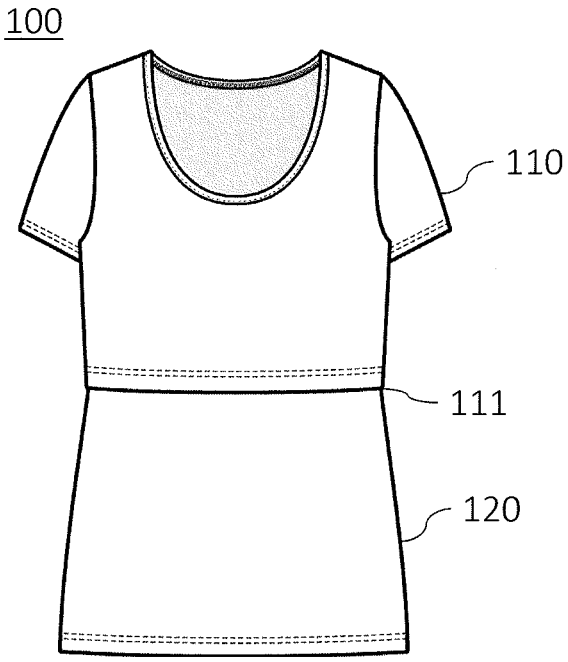
Figure 2D:
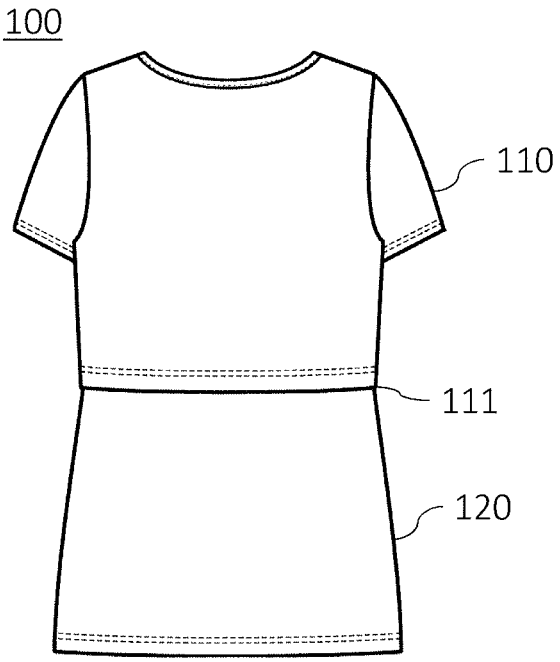

FIGS. 2*a*-2*d* illustrate different views of the garment 100 shown in FIG. 1. FIGS. 2*a* and 2*b* illustrate a front view and a back view, respectively, of the garment 100 with the inner layer 120 illustrated in grey, and FIGS. 2*c* and 2*d* illustrate a front view and a back view, respectively, of the physical outlines of the garment 100. In the garment 100 shown in FIG. 1 and FIGS. 2*a*-2*d*, the lower edge 111 of the outer layer 110 follows a straight horizontal line and is arranged a short distance below the lowermost edges 122 of the sleeve openings 121 of the inner layer 120. It is desirable that the outer layer 110 completely covers the sleeve openings 121 of the inner layer 120, so that the breasts are shielded from view, but it is at the same time desirable for the outer layer 110 not to extend too far below the lowermost edges 122 of the sleeve openings 121 of the inner layer 120, because this will make it unnecessarily cumbersome to lift the lower edge 111 of the outer layer 110 in order to access a breast through one of the sleeve openings 121 of the inner layer 120. The distance between the lowermost edges 122 of the sleeve openings 121 of the inner layer 120 and the lower edge 111 of the outer layer 110 may e.g. be 2-15 cm, or 10 cm or less, or 5 cm or less.

The inner layer 120 and the outer layer 110 of the garment 100 are preferably attached to each other in at least one point above the lowermost edges 122 of the sleeve openings 121 of the inner layer 120. The inner layer 120 and the outer layer 110 of the garment 100 may be attached to each other e.g. along at least a part of the shoulders, which connects the layers well together and makes the garment 100 easy to put on without having to adjust the inner layer 120. The inner layer 120 and the outer layer 110 of the garment 100 may also, or alternatively, be attached to each other e.g. around at least a part of the neckline. This may ensure that the inner layer 120 will not show through the neckline of the outer layer 110. The inner layer 120 and the outer layer 110 of the garment 100 may also, or alternatively, be attached to each other e.g. along a part of the sleeve openings.

Figure 3A:
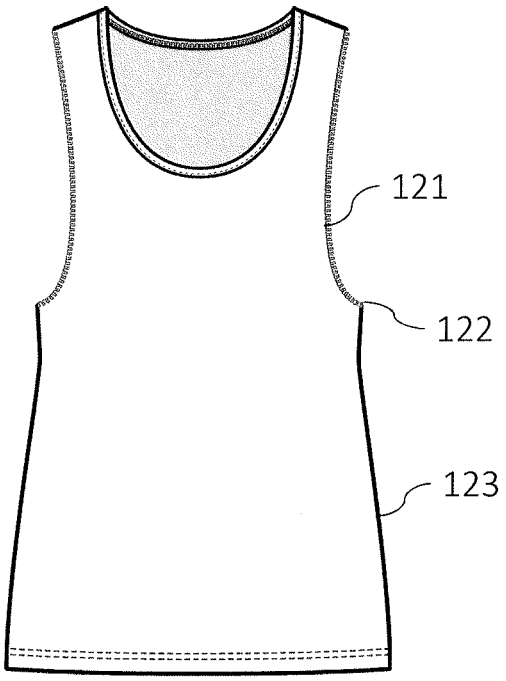
FIGS. 3*a*-3*b* illustrate an inner layer front section and an inner layer back section, respectively, of the garment shown in FIGS. 1 and 2*a*-2*d*.
Figure 3B:
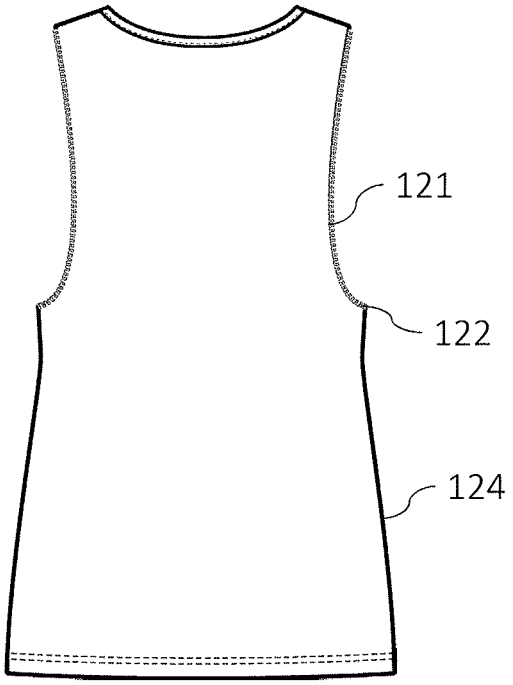

FIGS. 3*a*-3*b* illustrate the inner layer front section 123 and the inner layer back section 124, respectively, of the garment 100 shown in FIG. 1 and FIGS. 2*a*-2*d*. The inner layer 120 of the garment 100 may be formed by attaching the inner layer front section 123 and the inner layer back section 124 to each other at least at the sides. If they are attached to each other also along the shoulders, this creates a complete inner layer 120 which could be separately worn, and where the inner layer 120 and the outer layer 110 do not have to be attached to each other along the shoulders. The inner layer 120 is preferably sleeveless. The inner layer 120 may define the length of the garment 100, since it extends below the outer layer 110. The sleeve openings 121 of the inner layer front section 123 may be larger than the sleeve openings of the inner layer back section 124, to create an inner layer 120 with sleeve openings 121 which are larger at the front than at the back, for easier access to the breasts.

Figure 4A:
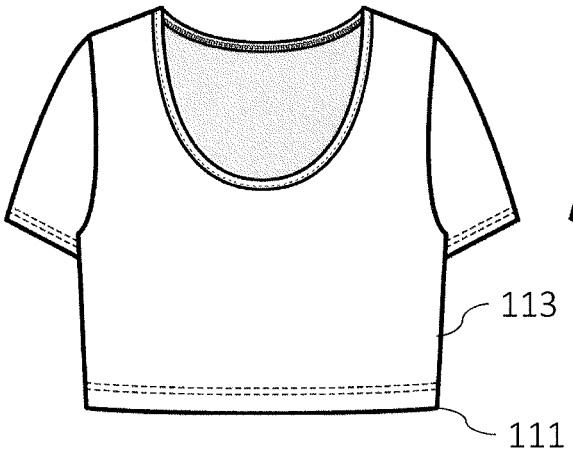
FIGS. 4*a*-4*b* illustrate an outer layer front section and an outer layer back section, respectively, of the garment shown in FIGS. 1 and 2*a*-2*d*.
Figure 4B:
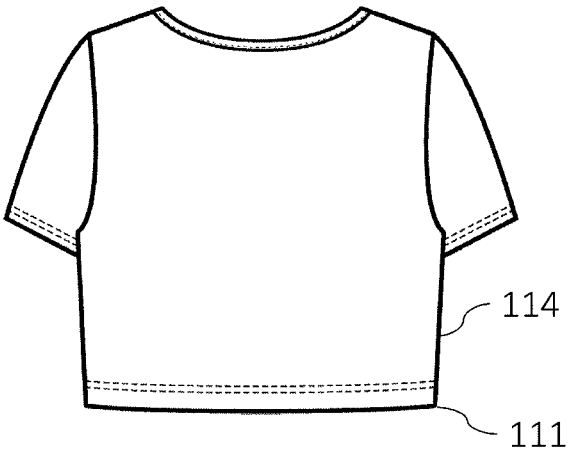

FIGS. 4*a*-4*b* illustrate the outer layer front section 113 and the outer layer back section 114, respectively, of the garment 100 shown in FIG. 1 and FIGS. 2*a*-2*d*. The outer layer 110 of the garment 100 may be formed by attaching the outer layer front section 113 and the outer layer back section 114 to each other at least at the sides. If they are attached to each other also along the shoulders, this creates a complete outer layer 110 which could be separately worn, and where the inner layer 120 and the outer layer 110 do not have to be attached to each other along the shoulders. The length of the outer layer 110 is selected so that it completely covers the sleeve openings 121 of the inner layer 120, so that the breasts are shielded from view, but at the same time does not extend too far below the lowermost edges 122 of the sleeve openings 121 of the inner layer 120, because this will make it unnecessarily cumbersome to lift the lower edge 111 of the outer layer 110 in order to access a breast through one of the sleeve openings 121 of the inner layer 120.

Figure 5A:
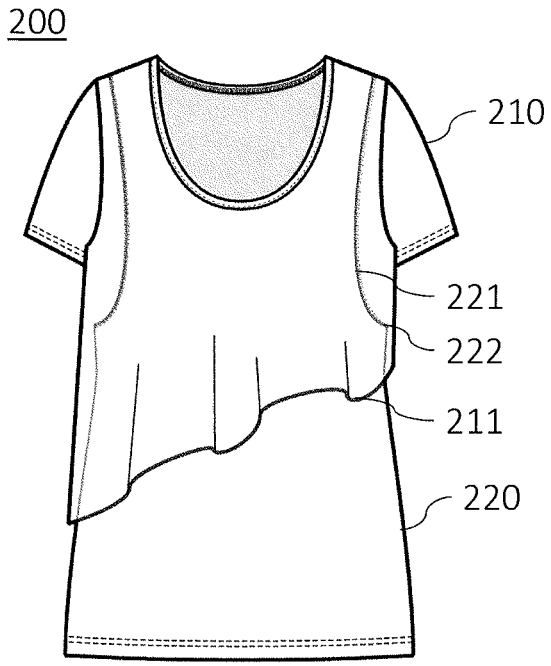
FIGS. 5*a*-5*d* illustrate different views of a garment suitable for nursing in accordance with one or more embodiments described herein.
Figure 5B:
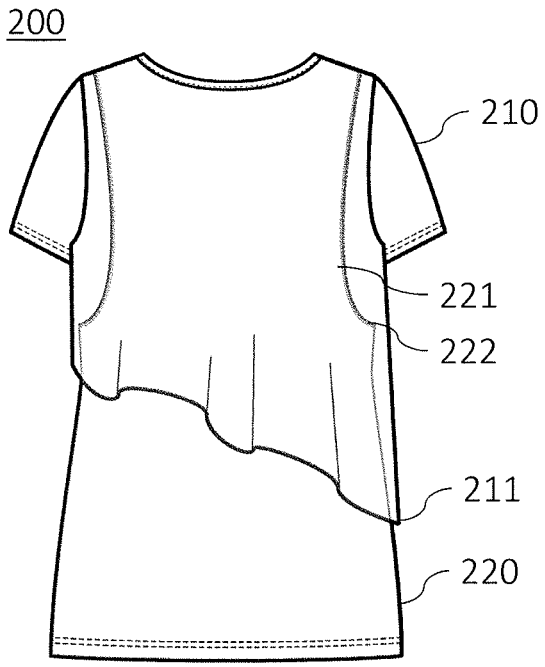
Figure 5C:
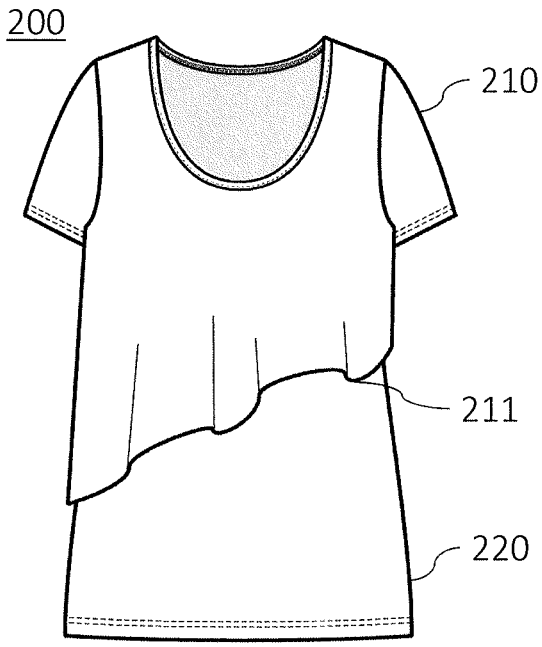
Figure 5D:
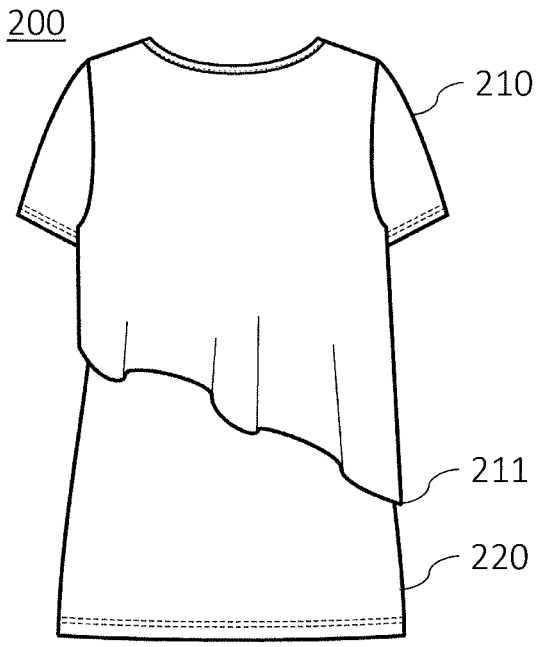

FIGS. 5*a*-5*d* illustrate different views of a garment 200 in accordance with one or more embodiments described herein. FIGS. 5*a* and 5*b* illustrate a front view and a back view, respectively, of the garment 200 with the inner layer 220 illustrated in grey, and FIGS. 5*c* and 5*d* illustrate a front view and a back view, respectively, of the physical outlines of the garment 200. In the garment 200 shown in FIGS. 5*a*-5*d*, the lower edge 211 of the outer layer 210 is at one side arranged a short distance below the lowermost edges 222 of the sleeve openings 221 of the inner layer 220, but at the other side arranged much further below the lowermost edges 222 of the sleeve openings 221 of the inner layer 220. The lower edge 211 of the outer layer 210 of the garment 200 thus follows a curved or asymmetrical line, so that the outer layer 210 is longer and/or shorter at some points along the circumference than at other points along the circumference. It is desirable that the outer layer 210 completely covers the sleeve openings 221 of the inner layer 220, so that the breasts are shielded from view, but it is at the same time desirable for the outer layer 210 not to extend too far below the lowermost edges 222 of the sleeve openings 221 of the inner layer 220, because this will make it unnecessarily cumbersome to lift the lower edge 211 of the outer layer 210 in order to access a breast through the sleeve opening 221 of the inner layer 220. However, as shown in FIGS. 5*a*-5*d*, the lower edge 211 of the outer layer 210 may be asymmetrical and not extend the same distance below the lowermost edges 222 of the sleeve openings 221 of the inner layer 220 at all points around the circumference of the garment 200. The lower edge 211 of the outer layer 210 may also be asymmetrical in other ways than what is shown in FIGS. 5*a*-5*d*, e.g. so that it extends the same distance below the lowermost edges 222 of the sleeve openings 221 of the inner layer 220 on both sides of the garment 200, but extends a longer or shorter distance below the lowermost edges 222 of the sleeve openings 221 of the inner layer 220 at other points around the circumference of the lower edge 211 of the outer layer 210. The distance between the lowermost edges 222 of the sleeve openings 221 of the inner layer 220 and the lower edge 211 of the outer layer 210 may e.g. be 2-15 cm, or 10 cm or less, or 5 cm or less at the shortest point. The distance may be longer than 15 cm at certain points along the circumference, as long as the outer layer 210 is still short enough for it not to be too cumbersome to lift the lower edge 211 of the outer layer 210 in order to access a breast through one of the sleeve openings 221 of the inner layer 220.

The inner layer 220 and the outer layer 210 of the garment 200 are preferably attached to each other in at least one point above the lowermost edges 222 of the sleeve openings 221 of the inner layer 220. The inner layer 220 and the outer layer 210 of the garment 200 may be attached to each other e.g. along at least a part of the shoulders, which connects the layers well together and makes the garment 200 easy to put on without having to adjust the inner layer 220. The inner layer 220 and the outer layer 210 of the garment 200 may also, or alternatively, be attached to each other e.g. around at least a part of the neckline. This may ensure that the inner layer 220 will not show through the neckline of the outer layer 210. The inner layer 220 and the outer layer 210 of the garment 200 may also, or alternatively, be attached to each other e.g. along a part of the sleeve openings.

The outer layer 110 and the inner layer 120 of the garment 100 shown in FIG. 1 and FIGS. 2*a*-2*d*, and the outer layer 210 and the inner layer 220 of the garment 200 shown in FIGS. 5*a*-5*d*, are attached to each other both along the shoulders and around the neckline. However, as explained above, the outer layer and the inner layer of the garment do not have to be attached to each other in this way, as long as they are attached to each other in at least one point above the lowermost edges of the sleeve openings of the inner layer. They may be attached to each other along a part of the shoulders, along a part of the neckline, and/or at some other point, such as along the top of the sleeve openings.

Figure 6A:
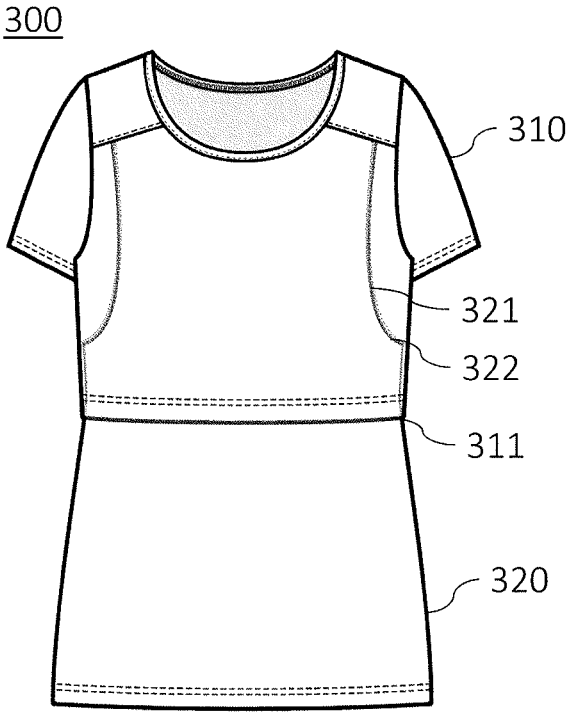
FIGS. 6*a*-6*b* illustrate different views of a garment suitable for nursing in accordance with one or more embodiments described herein.
Figure 6B:
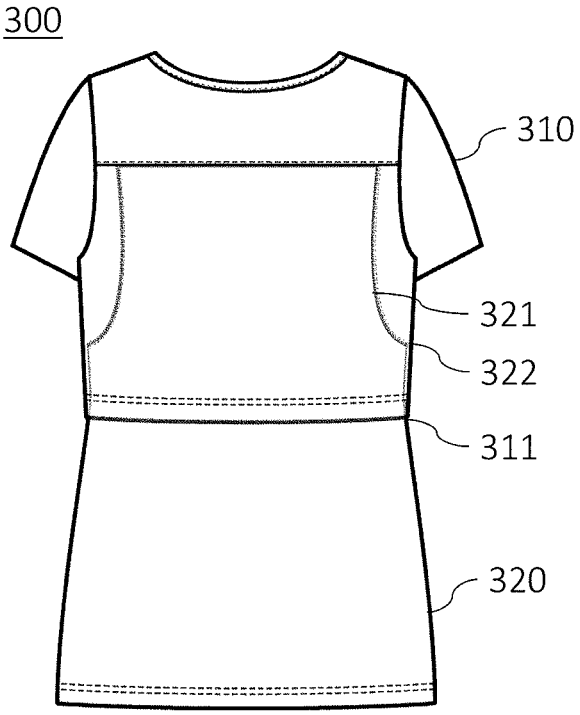

FIGS. 6*a*-6*b* illustrate different views of a garment 300 in accordance with one or more embodiments described herein. FIGS. 6*a* and 6*b* illustrate a front view and a back view, respectively, of the garment 300 with the inner layer 320 illustrated in grey. In the garment 300 shown in FIGS. 6*a*-6*b*, as in the garment 100 shown in FIG. 1 and FIGS. 2*a*-2*d*, the lower edge 311 of the outer layer 310 follows a straight horizontal line and is arranged a short distance below the lowermost edges 322 of the sleeve openings 321 of the inner layer 320. It is desirable that the outer layer 310 completely covers the sleeve openings 321 of the inner layer 320, so that the breasts are shielded from view, but it is at the same time desirable for the outer layer 310 not to extend too far below the lowermost edges 322 of the sleeve openings 321 of the inner layer 320, because this will make it unnecessarily cumbersome to lift the lower edge 311 of the outer layer 310 in order to access a breast through one of the sleeve openings 321 of the inner layer 320. The distance between the lowermost edges 322 of the sleeve openings 321 of the inner layer 320 and the lower edge 311 of the outer layer 310 may e.g. be 2-15 cm, or 10 cm or less, or 5 cm or less.

Figure 7A:
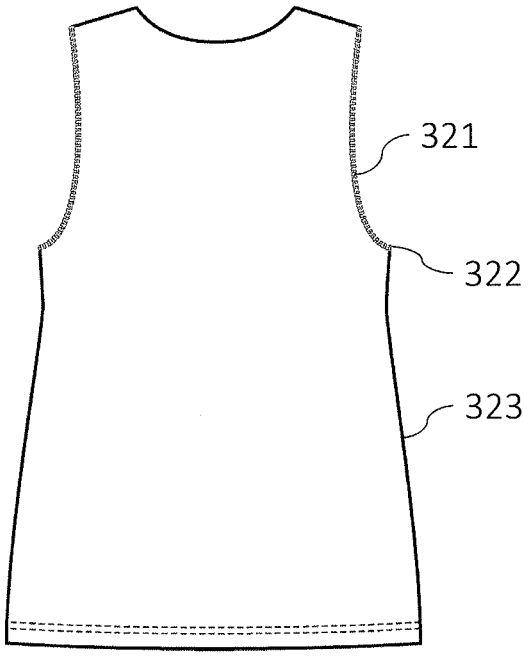
FIGS. 7*a*-7*b* illustrate an inner layer front section and an inner layer back section, respectively, of the garment shown in FIGS. 6*a*-6*b*.
Figure 7B:
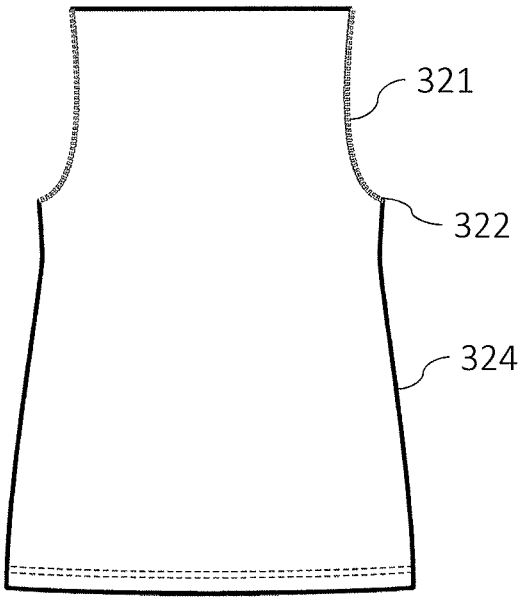

FIGS. 7*a*-7*b* illustrate the inner layer front section 323 and the inner layer back section 324, respectively, of the garment 300 shown in FIGS. 6*a*-6*b*. The inner layer 320 of the garment 300 may be formed by attaching the inner layer front section 323 and the inner layer back section 324 to each other at least at the sides. The inner layer 320 is preferably sleeveless. The inner layer 320 may define the length of the garment, since it extends below the outer layer. The sleeve openings 321 of the inner layer front section 323 may be larger than the sleeve openings of the inner layer back section 324, to create an inner layer 320 with sleeve openings 321 which are larger at the front than at the back, for easier access to the breasts.

Figure 8A:
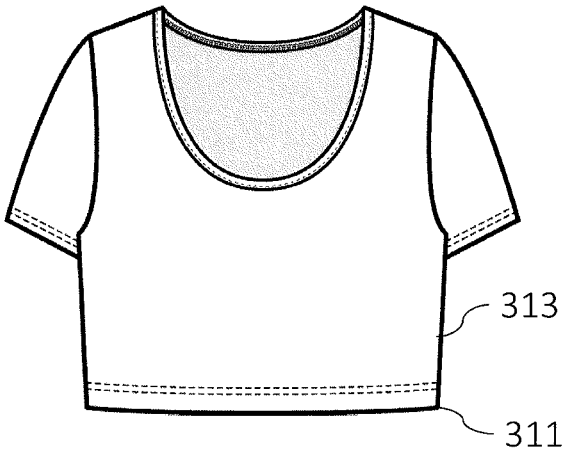
FIGS. 8*a*-8*b* illustrate an outer layer front section and an outer layer back section, respectively, of the garment shown in FIGS. 6*a*-6*b*.
Figure 8B:
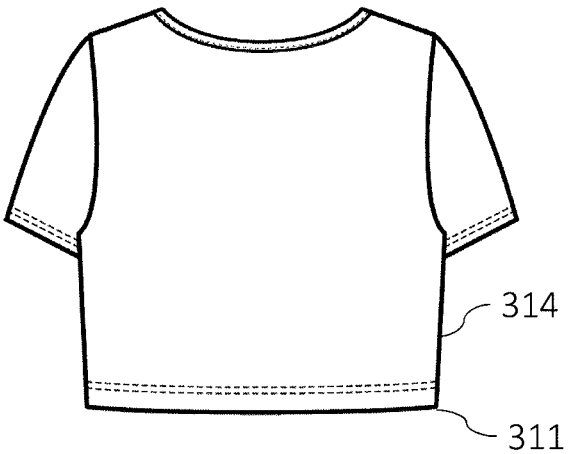

FIGS. 8*a*-8*b* illustrate the outer layer front section 313 and the outer layer back section 314, respectively, of the garment 300 shown in FIGS. 6*a*-6*b*. The outer layer 310 of the garment 300 may be formed by attaching the outer layer front section 313 and the outer layer back section 314 to each other at the sides and along the shoulders. The length of the outer layer 310 is selected so that it completely covers the sleeve openings 321 of the inner layer 320, so that the breasts are shielded from view, but at the same time does not extend too far below the lowermost edges 322 of the sleeve openings 321 of the inner layer 320, because this will make it unnecessarily cumbersome to lift the lower edge 311 of the outer layer 310 in order to access a breast through one of the sleeve openings 321 of the inner layer 320.

The inner layer 320 of the garment 300 differs from the inner layer 120 of the garment 100 in that the inner layer 320 does not extend all the way up to the shoulders of the garment 300, but instead the inner layer front section 323 is attached to the outer layer front section 313, and the inner layer back section 324 is attached to the outer layer back section 314. The inner layer 310 of the garment 300 thus cannot be separately worn.

In the same way, the garment 300 may alternatively comprise an outer layer 310 which does not extend all the way up to the shoulders of the garment 300, and where instead the inner layer front section 323 is attached to the outer layer front section 313, and the inner layer back section 324 is attached to the outer layer back section 314. In such a case, the outer layer 310 could not be separately worn.

There may also be embodiments where neither of the inner layer 320 and the outer layer 310 extends all the way up to the shoulders of the garment 300, but the garment is off-shoulder.

The inner layer 320 and the outer layer 310 of the garment 300 are preferably attached to each other in at least one point above the lowermost edges 322 of the sleeve openings 321 of the inner layer 320. The inner layer 320 and the outer layer 310 of the garment 300 may be attached to each other e.g. along a part of the garment 300 below the shoulders, which connects the layers well together and makes the garment 300 easy to put on without having to adjust the inner layer 320. The inner layer 320 and the outer layer 310 of the garment 300 may also, or alternatively, be attached to each other e.g. around at least a part of the neckline. This may ensure that the inner layer 320 will not show through the neckline of the outer layer 310. The inner layer 320 and the outer layer 310 of the garment 300 may also, or alternatively, be attached to each other e.g. along a part of the sleeve openings.

The garment 300 shown in FIGS. 6*a*-6*b* comprises an outer layer 310 which may be made from a number of different physical pieces. The outer layer front section 313 and the outer layer back section 314 may thus e.g. be made from a total of three different physical pieces, where one of the physical pieces overlaps between the front and the back of the outer layer 310. The outer layer front section 313 and the outer layer back section 314 thus do not have to be physically separated pieces, and they may be made from any number of different physical pieces.

According to the embodiments described, the garment 100, 200, 300 comprises an outer layer 110, 210, 310 and an inner layer 120, 220, 320 extending below the outer layer 110, 210, 310, wherein the inner layer 120, 220, 320 comprises an inner layer front section 123, 323 and an inner layer back section 124, 324 that are attached to each other at least at the sides, and the outer layer 110, 210, 310 comprises an outer layer front section 113, 313 and an outer layer back section 114, 314 that are attached to each other at least at the sides, and wherein the inner layer 120, 220, 320 and the outer layer 110, 210, 310 are attached to each other in at least one point above the lowermost edges 122, 222, 322 of the sleeve openings 121, 221, 321 of the inner layer 120, 220, 320, and the outer layer 110, 210, 310 comprises a lower edge 111, 211, 311 arranged below the lowermost edges 122, 222, 322 of the sleeve openings 121, 221, 321 of the inner layer 120, 220, 320, so that a breast can be accessed through one of the sleeve openings 121, 221, 321 of the inner layer 120, 220, 320 by lifting the lower edge 111, 211, 311 of the outer layer 110, 210, 310. The inner layer 120, 220, 320 is preferably sleeveless.

The garment 100, 200, 300 may be manufactured by manufacturing the inner layer 120, 220, 320 by attaching the inner layer front section 123, 323 and the inner layer back section 124, 324 to each other at least at the sides, manufacturing the outer layer 110, 210, 310 by attaching the outer layer front section 113, 313 and the outer layer back section 114, 314 to each other at least at the sides, and attaching the inner layer 120, 220, 320 and the outer layer 110, 210, 310 to each other in at least one point above the lowermost edges 122, 222, 322 of the sleeve openings 121, 221, 321 of the inner layer 120, 220, 320, so that a breast can be accessed through one of the sleeve openings 121, 221, 321 of the inner layer 120, 220, 320 by lifting the lower edge 111, 211, 311 of the outer layer 110, 210, 310. The inner layer front section 123 and the inner layer back section 124 of the garment 100, 200, 300 are preferably attached to each other along the shoulders, but this may be done when the inner layer 120, 220, 320 and the outer layer 110, 210, 310 are attached to each other, if they are attached to each other along the shoulders. It is thus not necessary to attach the inner layer front section 123, 323 and the inner layer back section 124, 324 to each other along the shoulders when the inner layer is manufactured. In the same way, it is not necessary to attach the outer layer front section 113, 313 and the outer layer back section 114, 314 to each other when the outer layer is manufactured—they could instead be attached to each other when the inner layer 120, 220, 320 and the outer layer 110, 210, 310 are attached to each other, if they are attached to each other along the shoulders.

The garment 100, 200, 300 according to this disclosure differs from prior art nursing garments in that the garment 100, 200, 300 comprises an inner layer 120, 220, 320 and an outer layer 110, 210, 310 which are not attached to each other at the sides. This means that the lower edge 111, 211, 311 of the outer layer 110, 210, 310 hangs freely around the entire garment 100, 200, 300 so that the lower edge 111, 211, 311 of the outer layer 110, 210, 310 can easily be lifted in order to access a breast through one of the sleeve openings 121, 221, 321 of the inner layer 120, 220, 320. The garment 100, 200, 300 facilitates breastfeeding, since an outer layer 110, 210, 310 which is not attached to the inner layer 120, 220, 320 below the sleeve openings 121, 221, 321 but instead hangs freely is easy to lift in order to access a breast through one of the sleeve openings 121, 221, 321 of the inner layer 120, 220, 320.

The garment may be any type of garment that covers the breasts of the user. It may e.g. be a t-shirt, a jumper, a blouse, or a dress of any length, and it may have long sleeves, short sleeves or be entirely sleeveless. The inner layer is preferably sleeveless, but may comprise a short sleeve, or a sleeve which is not attached to the sleeve opening around the lower edge of the sleeve opening. A garment having sleeves may have a sleeveless outer layer and an inner layer having sleeves, although the opposite is preferred.

The lower edge of the inner layer does not have to be hanging freely, but may e.g. be arranged around the crotch of the user. The garment may thus also be e.g. a body, a bathing suit or a jumpsuit. The garment may be made from any material, and it may be made from a number of different materials. For example, the outer layer and the inner layer do not have to be made from the same material, and the material in any of the layers may comprise different layers in itself. The material of the garment is preferably elastic, but this is not necessary as long as the outer layer is wide enough to be easily lifted anyhow if the material of the outer layer is not elastic.

The inner layer and the outer layer may be attached to each other at any point above the lowermost edges of the sleeve openings of the inner layer. The outer layer and the inner layer may e.g. be attached to each other along the shoulders, or a part of the shoulders. The outer layer and the inner layer may e.g. also or alternatively be attached to each other around the neckline, or a part of the neckline, but this is not necessary if a nice look can be ascertained in other ways. The outer layer and the inner layer may e.g. also or alternatively be attached to each other along a part of the sleeve openings.

The neckline of the garment may have any shape. It may be round, as shown in the figures, but it may alternatively be any other shape, such as e.g. v-shaped. The inner layer may in this case e.g. have a collar sticking out of the v-shaped neckline of the outer layer.

The garment may comprise any number of additional pieces or sections, in addition to the pieces and sections described above.

The foregoing disclosure is not intended to limit the present invention to the precise forms or particular fields of use disclosed. It is contemplated that various alternate embodiments and/or modifications to the present invention, whether explicitly described or implied herein, are possible in light of the disclosure. Accordingly, the scope of the invention is defined only by the claims.

The invention claimed is:

1. A garment suitable for nursing, the garment comprising an outer layer and an inner layer extending below the outer layer, wherein the inner layer comprises an inner layer front section with sides and an inner layer back section with sides, the inner layer front section and the inner layer back section are attached together at least at the respective sides of the inner layer front section and the inner layer back section, and the outer layer comprises an outer layer front section with sides and an outer layer back section with sides, the outer layer front section and the outer layer back section are attached together at least at the respective sides of the outer layer front section and the outer layer back section, and wherein at least a part of a neckline of the inner layer and at least a part of a neckline of the outer layer are attached to each other, but not directly affixed to each other below lowermost edges of sleeve openings of the inner layer, and the outer layer comprises a lower edge arranged below the lowermost edges of the sleeve openings of the inner layer, so that the lower edge of the outer layer hangs freely outside the inner layer around the entire garment and thus can be easily lifted to access a breast of a wearer through one of the sleeve openings of the inner layer, wherein the distance between the lowermost edges of the sleeve openings of the inner layer and the lower edge of the outer layer at least at one of the sides is 2-15 cm.

2. The garment according to claim 1, wherein the inner layer is sleeveless.

3. The garment according to claim 1, wherein the inner layer front section and the inner layer back section are also attached to each other along shoulders of the garment.

4. The garment according to claim 1, wherein the outer layer front section and the outer layer back section are also attached to each other along shoulders of the garment.

5. The garment according to claim 1, wherein both the inner layer and the outer layer are arranged to cover the breasts of the wearer when the garment is worn.

6. The garment according to claim 1, wherein the lower edge of the outer layer follows a straight horizontal line.

7. The garment according to claim 1, wherein the lower edge of the outer layer follows a curved or asymmetrical line, so that the outer layer is longer and/or shorter at some points along the circumference than at other points along the circumference.

8. A method of manufacturing the garment according to claim 1, the method comprising:

manufacturing the inner layer by attaching an inner layer front section and an inner layer back section to each other at least at sides thereof;

manufacturing the outer layer by attaching an outer layer front section and an outer layer back section to each other at least at sides thereof; and attaching the inner layer and the outer layer to each other around at least a part of a neckline of the garment, but not directly affixing the inner layer and the outer layer to each other below the lowermost edges of the sleeve openings of the inner layer.

9. The method according to claim 8, further comprising manufacturing the inner layer using a sleeveless inner layer front section and a sleeveless inner layer back section.

10. The method according to claim 8, further comprising attaching the inner layer front section and the inner layer back section to each other also along shoulders of the garment.

11. The method according to claim 8, further comprising attaching the outer layer front section and the outer layer back section to each other also along shoulders of the garment.

12. The method according to claim 8, further comprising manufacturing the inner layer using an inner layer front section that is arranged to cover the breasts of the wearer when the garment is worn.

13. The method according to claim 8, further comprising attaching the inner layer and the outer layer to each other in such a way that the distance between the lowermost edges of the sleeve openings of the inner layer and the lower edge of the outer layer at least at one of the sides is 2-15 cm.

14. The method according to claim 8, further comprising manufacturing the outer layer using an outer layer front section and an outer layer back section each of which follows a straight horizontal line.

15. The method according to claim 8, further comprising manufacturing the outer layer using an outer layer front section and/or an outer layer back section the lower edge of which follows a curved or asymmetrical line, so that the outer layer becomes longer and/or shorter at some points along the circumference than at other points along the circumference.

* * * * *